US006082769A

United States Patent [19]

Park

[11] Patent Number: 6,082,769

[45] Date of Patent: Jul. 4, 2000

[54] CLIP FOR BINDING CUT SHEETS USED WITH A MULTI-FUNCTIONAL PICTURE BOOK LEARNING SYSTEM

[75] Inventor: Kwang-Sig Park, Seoul, Rep. of Korea

[73] Assignee: SamSung Electronics Co., Ltd., Kyungki-do, Rep. of Korea

[21] Appl. No.: 09/049,029

[22] Filed: Mar. 27, 1998

[30] Foreign Application Priority Data

Mar. 27, 1997 [KR] Rep. of Korea ..... 97-10778

[51] Int. Cl.[7] ..... B42D 1/00

[52] U.S. Cl. ..... 281/21.1; 281/15.1; 281/29; 281/36; 402/21; 402/80 P

[58] Field of Search ..... 402/19, 21, 80 P; 281/21.1, 15.1, 29, 36, 37, 38

[56] References Cited

U.S. PATENT DOCUMENTS

| | | | |
|---|---|---|---|
| 1,027,523 | 5/1912 | Buchan . | |
| 1,397,577 | 11/1921 | Engelland | 402/21 |
| 1,448,914 | 3/1923 | Dally . | |
| 2,127,416 | 8/1938 | Martin . | |
| 2,139,480 | 12/1938 | Young | 402/21 |
| 2,202,567 | 5/1940 | Spinner . | |
| 2,322,176 | 6/1943 | Trussell | 402/21 |
| 2,425,205 | 8/1947 | Raynolds . | |
| 2,459,541 | 1/1949 | Russell | 402/21 |
| 3,205,897 | 9/1965 | Jamison . | |
| 3,220,078 | 11/1965 | Preziosi | 402/80 P |
| 3,522,665 | 8/1970 | Kalt . | |
| 3,574,472 | 4/1971 | Gott . | |
| 3,939,968 | 2/1976 | Gilbert . | |
| 4,511,274 | 4/1985 | Chen | 402/21 |
| 4,800,947 | 1/1989 | Loomis . | |
| 4,809,246 | 2/1989 | Jeng . | |
| 5,036,973 | 8/1991 | Aida | 402/80 P |
| 5,174,759 | 12/1992 | Preston et al. . | |
| 5,287,254 | 2/1994 | Solman . | |
| 5,417,575 | 5/1995 | McTaggart . | |
| 5,626,432 | 5/1997 | Swift et al. . | |
| 5,642,557 | 7/1997 | Clews . | |

*Primary Examiner*—Andrea L. Pitts
*Assistant Examiner*—Monica Smith Carter
*Attorney, Agent, or Firm*—Robert E. Bushnell, Esq.

[57] ABSTRACT

A clip for securing cut sheets of image bearing medium to a notebook or picture book is provided that has an inverted U-shape. The clip is made of an elastic material that has a latch on either end to attach to a cavity in either a notebook, picture book, or similar device. The clip can be made symmetrically so that it can be operated while in a reversed orientation. By producing the clip as a detachable piece, repairs to a picture book become trivial because one can discard the broken clip and simply replace it without needing to discard the entire picture book. Furthermore, this type of paper binding means is ideal for children and the handicapped as the clips can be made of low enough rigidity to enable them to be simply operated, while reducing the odds of accidents resulting from sharp edges or metallic parts. Manufacturing efficiency is increased because the clips and the notebooks can be produced separately and sold disconnected.

18 Claims, 7 Drawing Sheets

CLIP FOR BINDING CUT SHEETS USED WITH A MULTI-FUNCTIONAL PICTURE BOOK LEARNING SYSTEM

CLAIM OF PRIORITY

This application makes reference to, incorporates the same herein, and claims all rights accruing thereto under 35 U.S.C. §119 through my patent application entitled *Fixing Structure of a Picture Book Package for a Multi-Purpose Learning System* earlier filed in the Korean Industrial Property Office on the Mar. 27, 1997 and there duly assigned Ser. No. 1997/10778.

BACKGROUND OF THE INVENTION

1. Field of the Invention

The present invention relates to a binding means for a notebook and, more specifically, to a device for binding cut sheets used with a multi-functional picture book learning system.

2. Background Art

A great amount of material is published or otherwise disseminated in the form of periodicals, pamphlets, catalogs, price lists, brochures, calenders, and reports and the like, all of which have are composed of a relatively small number of cut sheets of a printable medium. This material is not ordinarily circulated to the same extent as a bound book would be, and as such is often used to satisfy relatively short term needs. Consequently, collections of such cut sheets do not merit the expenditure of much more than a nominal amount of money for their binding. Nevertheless, for a binding to be suitable, the binding means must allow the bound pages to be turned over while maintaining their flat condition and must be able to withstand some abuse.

Some binding means are also integrated with specific multi-functional devices, such as a multi-functional picture book learning system. These learning systems are especially useful today as the amount of information that a person needs to assimilate increases. To effectively absorb data, full comprehension is crucial. It is also known that proper comprehension of written materials depends on the viewer's ability to interpret visually perceivable information and the ability to interpret the information using previously acquired knowledge that is associated with the information. One of the techniques that has been found for increasing comprehension is the use of video and audio outputs in combination with text to transfer information. This may be accomplished using a picture book that combines information on cut sheets with a video and audio generating source. Picture books can be used to stimulate a child's interest and increase a child's reading skill, visual acuity, ability to differentiate colors, and stimulate the child's imagination. Additionally, some multi-functional picture books receive input from children via a touch sensitive screen. Thus, a child can select a certain picture icon to activate related audio and visual outputs. These multi-functional learning systems can be used for a wide variety of uses, ranging from playing games to drawing, writing, and communicating.

For a multi-functional picture book learning system to be effective a binding means must be used that secures the cut sheets in the proper order while allowing the cut sheets to be easily changed. Some techniques for securing cut sheets are shown, for example, in U.S. Pat. No. 5,642,557 to Clews entitled *Panel Display System,* U.S. Pat. No. 4,800,947 to Loomis entitled *Tension Mounting System and Assembly,* U.S. Pat. No. 2,425,205 to Raynolds entitled *Loose Leaf Binder,* U.S. Pat. No. 2,202,567 to Spinner entitled *Ringlike Devices,* U.S. Pat. No. 3,205,897 to Jamison entitled *Binder Means,* U.S. Pat. No. 3,574,472 to Cott entitled *Binder for Perforated Loose Leaves,* U.S. Pat. No. 5,626,432 to Swift entitled *Adjustable Locking Binder,* U.S. Pat. No. 5,174,759 to Preston entitled *TV Animation Interactively Controlled by the Viewer Through Input Above a Book Page,* U.S. Pat. No. 5,417,575 to McTaggert entitled *Electronic Book,* U.S. Pat. No. 5,287,254 to Solman entitled *Illuminated Writing Table,* U.S. Pat. No. 4,809,246 to Jeng entitled *Sound Illustrated Book Having Page Indicator Circuit,* U.S. Pat. No. 3,522,665 to Kalt entitled *Teaching System,* U.S. Pat. No. 2,127,416 to Martin entitled *Loose Leaf Binding*, U.S. Pat. No. 1,448,914 to Dally entitled *Binder for Magazines and the Like,* U.S. Pat. No. 1,027,523 to Buchan entitled *Loose Leaf Binder,* U.S. Pat. No. 3,936,968 to Gilbert entitled *Adjustable Frame.* Conventional devices for securing cut sheets tend to be made of sharp metallic components or require a significant amount of force to manipulate and thus, can pose a safety hazard for little children. Additionally, contemporary devices for securing cut sheets lack a device that is designed for use with a notebook, that is easy to attach and detach from the notebook, that is easy to replace, that can be replaced without having to discard the notebook, and that is made of a unitary piece to avoid pinching the skin of children that are operating the device.

As such, I believe it may be possible to improve on the contemporary art by providing a device for securing cut sheets to a notebook that can be produced independently from the associated notebook and thus increases overall manufacturing efficiency, that is easy to attach and detach from a notebook, that is easy to replace or repair, that can be replaced without having to discard the associated notebook, that does not require significant force to operate, that is made of a unitary piece to avoid pinching the skin of children that are operating the device.

SUMMARY OF THE INVENTION

Accordingly, it is an object of the present invention to provide a device for securing cut sheets to a notebook that can be manufactured and packaged separately from their associated notebooks to increase overall manufacturing efficiency.

It is another object to provide a clip for securing cut sheets to a notebook that is easy for a child to attach and detach from a notebook.

It is still another object to provide a clip for securing cut sheets to a notebook that are easy to replace or repair.

It is yet another object to provide a clip for securing cut sheets to a notebook that can be replaced without having to discard the associated notebook.

It is still yet another object to provide a clip for securing cut sheets to a notebook that does not require significant force to operate.

It is a further object to provide a clip for securing cut sheets to a notebook that is made of a unitary piece and can be rotated through 180 degrees and still inserted properly into a notebook.

It is a further object still to provide a clip for securing cut sheets to a notebook that is safe for children to operate without getting their skin pinched by the device.

It is still yet a further object to provide a picture book used in combination with an improved clip.

To accomplish these and other objects, a clip for securing cut sheets of image bearing medium to a notebook or picture book is provided that has an inverted U-shape. The clip is made of an elastic material that has a latch on either end to attach to a receptacle in either a notebook, a picture book, or a similar device (hereinafter collectively referred to as "picture book"). The clip can be made symmetrically so that it can be operated while in a reversed orientation. By producing the clip as a detachable piece, repairs to a picture book become trivial because one can discard the broken clip and simply replace it without needing to discard the entire picture book. Furthermore, this type of paper binding means is ideal for children and the handicapped because the clips can be constructed of a material having a low enough rigidity to enable them to be easily operated. At the same time, the clips as constructed according to the principles of the present invention reduce the probability of accidents resulting from sharp edges or metallic parts. While the clips can be constructed out of a metal they can also be constructed out of a plastic or any material having suitable elasticity. Manufacturing efficiency is increased because the clips and the notebooks can be produced separately and sold disconnected.

When the clip is used with a picture book, one groove can be longer than the other by the width of a cut sheet to allow the clip to clamp the last page of the picture book against the picture book stand. Additionally, a clamp or similar elastic device can be used to restrain an opposing edge of the last page. Alternatively, the surface of the picture book stand can have a depression to allow the last cut sheet to be recessed into the stand.

The pages of the picture book have a number of holes corresponding to the number of receptacles built into the picture book. The clips are simply inserted through holes in the cut sheets and then inserted into the corresponding receptacles. To insert a clip into a receptacle, the ends of the clip are pressed together and the clip is inserted. Once the clips are pushed through the cut sheets and secured to the receptacles in the picture book, the cut sheets may be freely turned while being kept in order.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
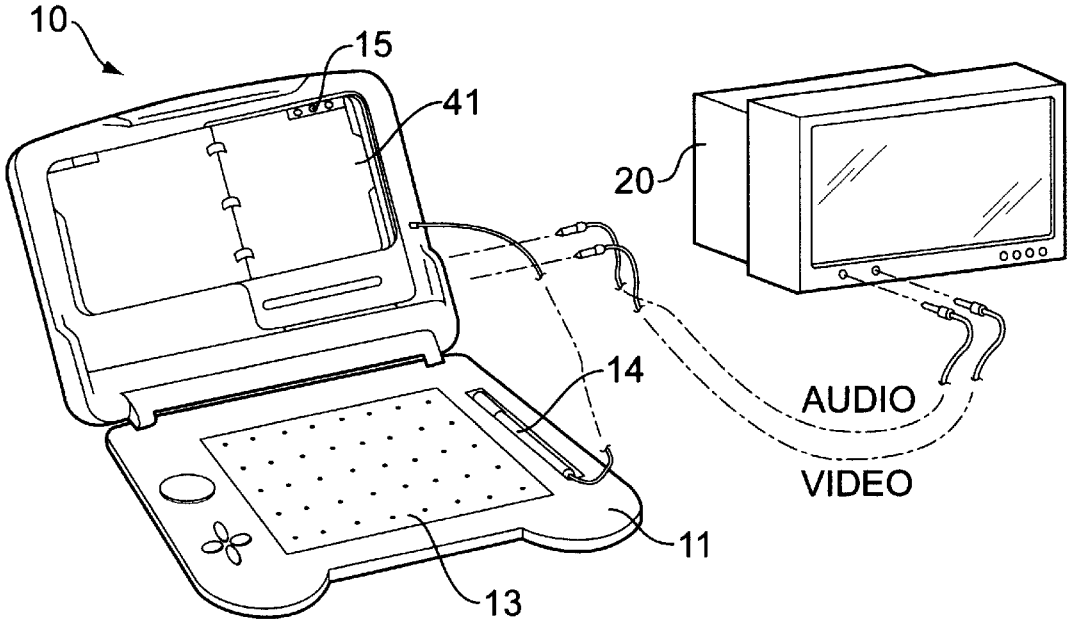
FIG. 1 is a schematic plan view of a multi-functional learning system.
Figure 2:
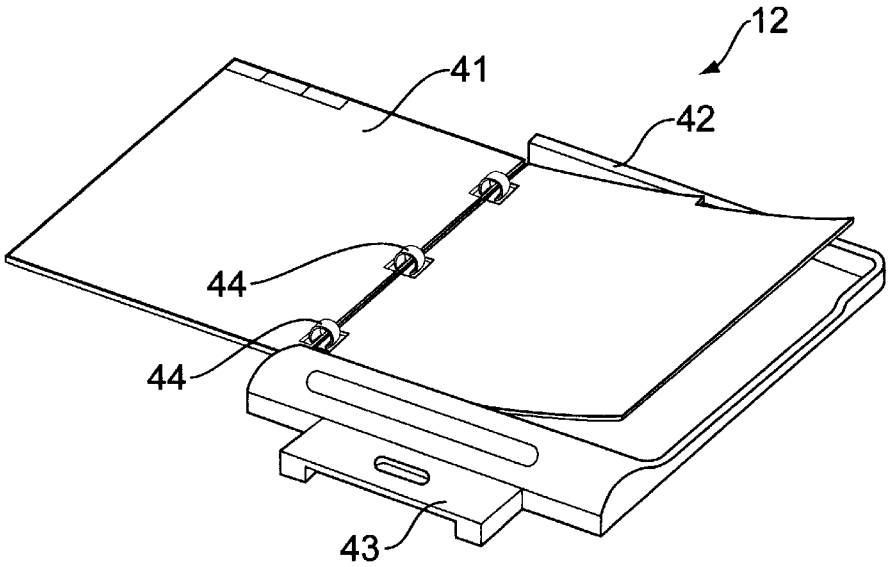
FIG. 2 is a perspective view of a picture book.

Turning now to the drawings, FIG. 1 illustrates multi-functional picture book learning system 10 that may be constructed using a base 11 and a flippable supporting stand 12 that is pivotally mounted on base 11. Cut sheets 41 are attached to flippable supporting stand 12, as shown in FIG. 2. The flippable supporting stand 12 and base 11 learning system may include a number of controllers for regulating the operation of learning system 10, an audio output tenninal, a video output terminal, and a separate audio visual unit, such as a television. Base 11 may include touch pad 13 and electronic pen 14. These components would allow a user to draw figures on touch board 13, using electronic pen 14, that are then viewable on audio and visual terminal 20. Additionally, by using electronic pen 14, a user can select a picture icon displayed on the monitor by pointing pen at the icon. As shown in FIG. 2, supporting stand 12 has a number of cut sheets 41 that contain the text and pictures comprising the story book. The details of the story are contained on a number of cut sheets 41 that are attached to supporting stand 12 by clips 44. Main body 42 of the supporting stand 12 contains detectors (not shown) that in combination with memory 43 manipulate the related multi-media information that corresponds to each picture of the picture book.

When all the cut sheets 41 representing complete story book 12 are inserted in the appropriate position on supporting stand 12 and the power is turned on, the corresponding audio and visual information is sent to audio and visual unit 20. Then, as each cut sheet 41 is read, page sensors 15 that are installed on the upper part of the flippable supporting stand 12 determine the page currently being read.

Accordingly, when the user turns a page in the picture book, the controller (not shown) of learning system 10 can determine the particular page being viewed due to data transmitted by sensors 15. Then, the controller outputs the corresponding audio and video presentations via audio and visual terminal 20 that correspond to the page being viewed. Adequate operation of the learning system depends on the proper securing of the cut sheets of the picture book to supporting stand 12.

Figure 3:
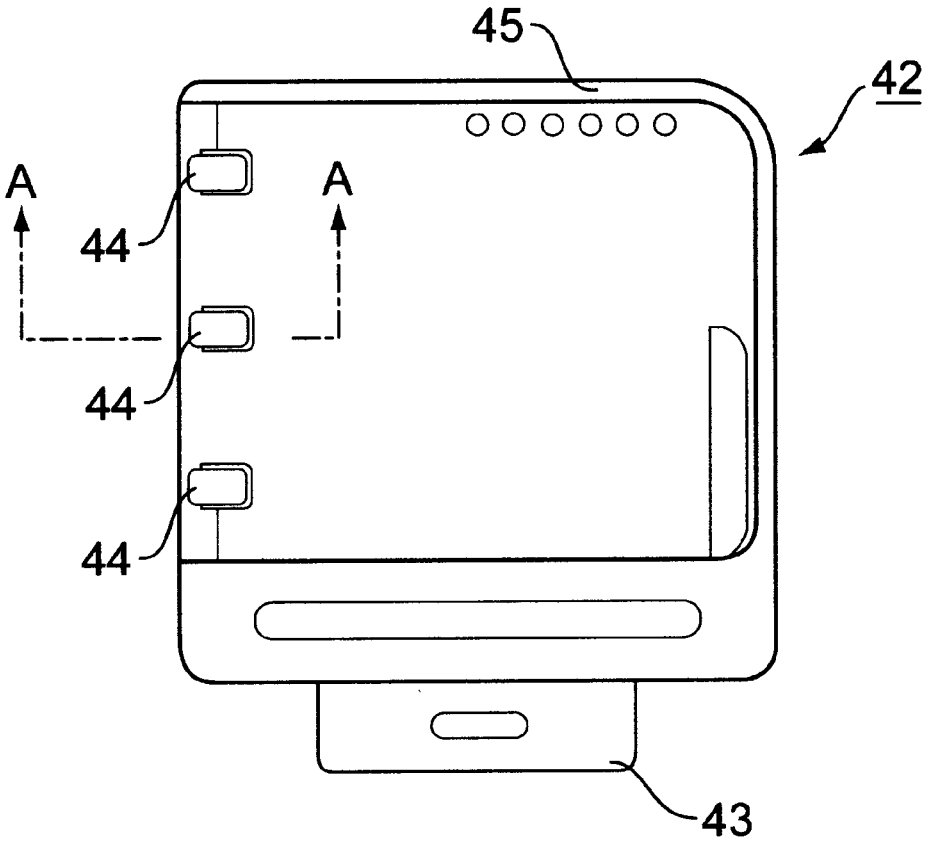
FIG. 3 is a plan view of a stand used to support cut sheets in a picture book.
Figure 4:
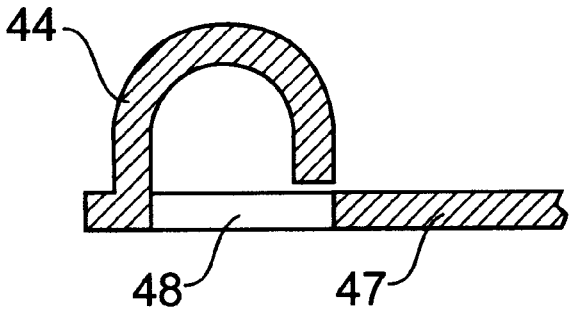
FIG. 4 is a cross-sectional view taken along the line A and A' of FIG. 3.
Figure 5A:
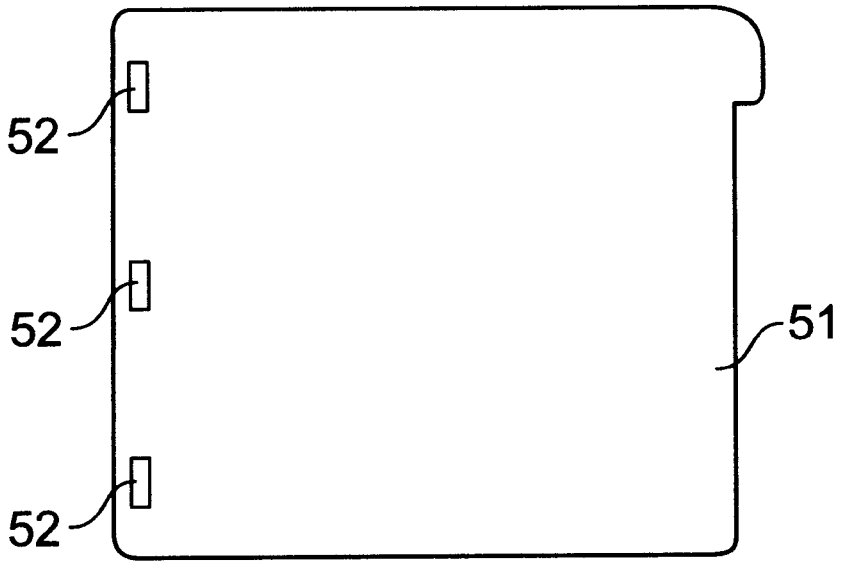
FIG. 5*a* is a plan view of cut sheets used with a picture book.
Figure 5B:
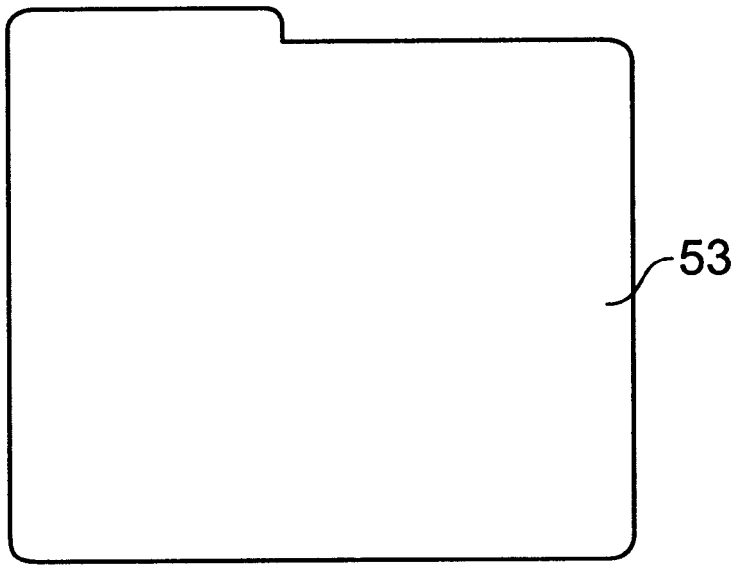
FIG. 5*b* is a plans view of the last cut sheet of a picture book.

FIG. 3 illustrates a plan view of supporting stand 42. The cut sheets are secured to the stand via clips 44 and enclosed by main body portion 45. FIG. 4 is a cross sectional view of clip 44 as taken along the line A and A' shown in FIG. 3. The left side of clip 44 is engaged to supporting stand 12 and the right side of clip 44 is designed to leave a gap between the clip and the top surface of the supporting stand 12. To engage support stand 12, clip 44 is inserted into a receptacle in support stand 12. FIG. 5*a* illustrates a plan view of cut sheet 51 used in a picture book, while FIG. 5*b* illustrates the configuration of the last page of a story book designed for use with learning system 10. Last page 53 of the picture book does not need to be penetrated by clip 44 and thus, does not have the perforations 52 that are shown in FIG. 5*a*. Thus, last page 53 needs to be secured to main body 42 of supporting stand 12 to prevent the picture book from moving loosely when a user turns the cut sheets.

Figure 6:
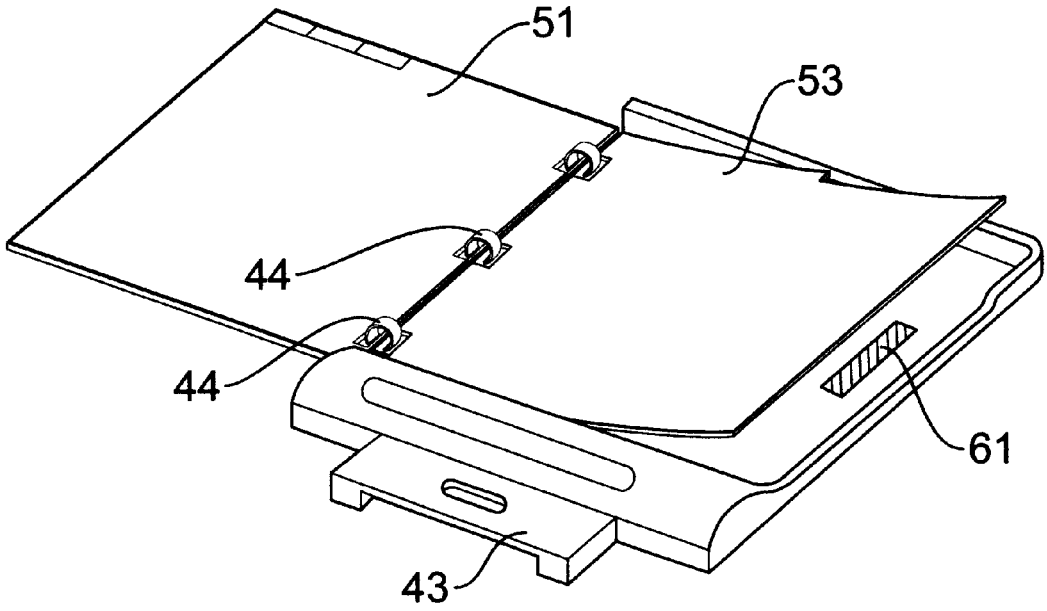
FIG. 6 is a perspective view of a supporting stand for a picture book.

FIG. 6 is a perspective view of supporting stand for a picture book. Last page 53 is secured to the supporting stand 12 via double-sided tape 61 that is positioned on the upper surface of the supporting stand.

Figure 7:
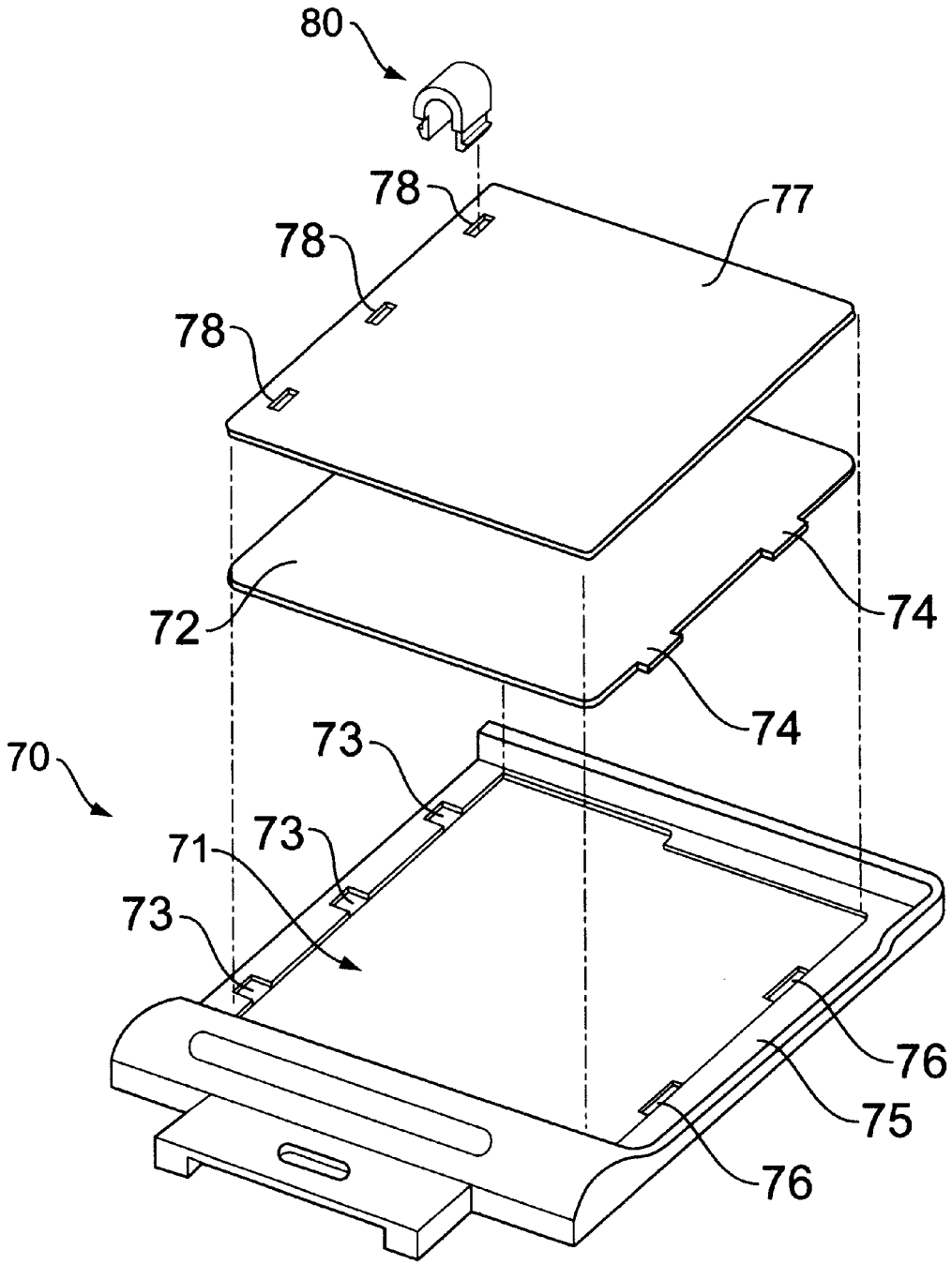
FIG. 7 is a perspective view of a supporting stand for a picture book as constructed according to the principles of the present invention.

FIG. 7 illustrates a picture book as constructed according to the principles of the present invention. Uniformly positioned receptacles 73 are located on the left side of main body 71 of supporting stand 70. Clip 80 is latchably engageable with receptacle 73 and is used to secure the cut sheets 77 to supporting stand 70. Last page 72 of the picture book is inserted first on the top surface of supporting stand 70. To prevent a portion of last page 72 from covering up receptacles 73, last page 72 should be pushed in a right most direction after being positioned on the top surface of the stand. Moreover, since the right side of the last page 72 has tabs 74, the tabs may be inserted under projecting member 76 of main body portion 75. Cut sheets 77 of the picture book, except for the last page 72, have a number of perforations 78 corresponding to the number of receptacles 73.

Figure 8:
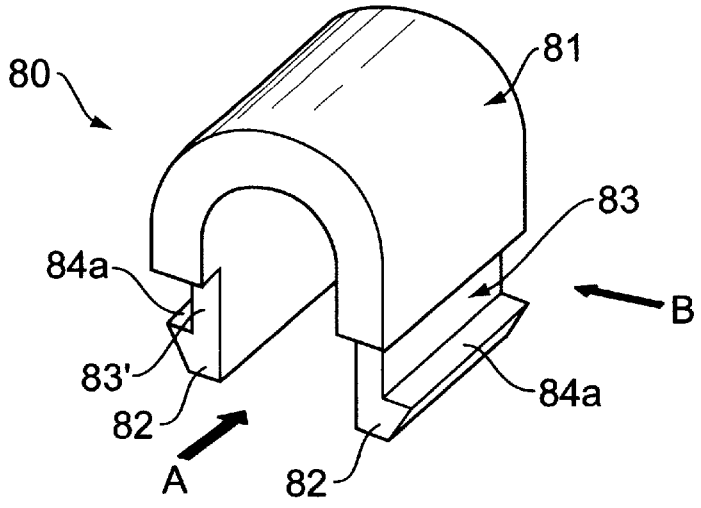
FIG. 8 is a perspective view of the clip of FIG. 7.
Figure 9A:
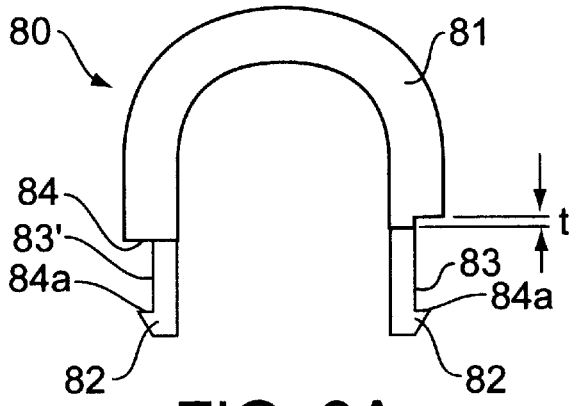
FIG. 9*a* is an elevational view of the clip of FIG. 8 as viewed from the direction of arrow A.
Figure 9B:
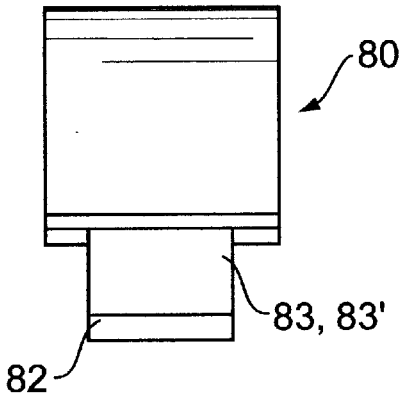
FIG. 9*b* is an elevational view of the clip of FIG. 8 as viewed from the direction of arrow B.

FIG. 8 is a perspective view of clip 80 as constructed according to the principles of the present invention. Clip 80 may be constructed using U-shaped member 81 that has grooves 83 and 83' near its distal ends. Each distal end has latch 82 attached to engage receptacle 73. FIG. 9*a* shows clip 80 as seen from the direction of arrow "A" and illustrates that grooves 83 and 83' can differ in length by a difference "t". Difference "t" should be equal to the thickness of the last page of the picture book. This allows the edge of the last page to be clamped under the clip while the rest of the cut sheets are free to move around U-shaped member 81. Surface 84 comes into contact with the top surface of the supporting stand when clip 80 is engaged with the appropriate receptacle. FIG. 9*b* shows clip 80 as seen from the direction of arrow "B".

Figure 10:
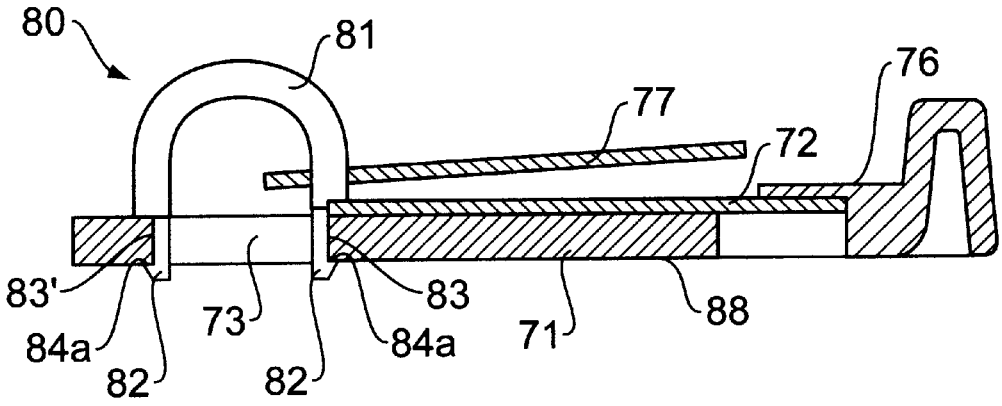
FIG. 10 is a plan view of the picture book of FIG. 7 illustrating how each cut sheet of the picture book is attached to the supporting stand.

FIG. 10 is a cross-sectional view showing clip 80 securing cut sheets 77 and last page 72 to supporting stand 70. Groove 83 of clip 80 is longer by the thickness of last page 72 to allow the clip to clamp the last page against main body 71 of supporting stand 70. Additionally, the last page is restrained by projection member 76. To correctly place last page 72 onto the supporting stand, the left side of the last page must be aligned with the edge of receptacles 73. Then, the rest of the cut sheets can be mounted by perforations 78 with one end of clip 80. Once all the necessary pages are mounted and the clip 80 is fully engaged with receptacle 73, the picture book is ready for use. When clip 80 is fully engaged with main body 71 supporting stand 70, surface 84*a* of latches 82 of the clip is in contact with button surface 88 of main body 71 of supporting stand 70.

Figure 11:
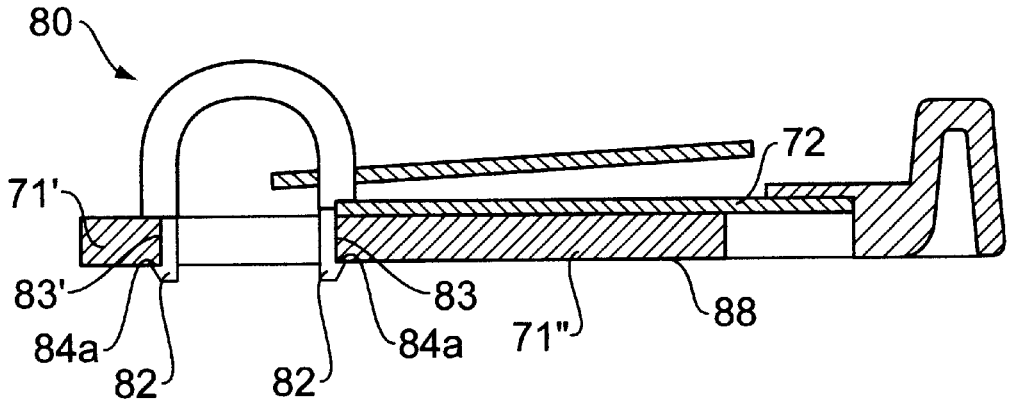
FIG. 11 is a plan view of another embodiment of the supporting stand of FIG. 7 illustrating an alternative method of securing the last page of the cut sheets to the top surface of the supporting stand.

As shown in FIG. 11, grooves 83 and 83' of clip 80 can be of equal length. When this clip is used with a story book main body 71 of, the supporting stand 70" has a depression that recesses the last page inside of the top surface of main body 71" of the supporting stand 70. The depression should be the thickness of the last page of the picture book and allows the last page to be restrained by clip 80.

In sum, the present invention provides a supporting stand for a picture book for use with a multi-functional learning system that uses clips that can be produced separately, thus improving manufacturing efficiency. By using the clip in combination with the supporting stand, the supporting stand of the present invention eliminates the need for using double-side tape to secure the last page of a story book.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A binder, comprising:

a supporting stand including a receptacle having a first wall and a second wall;

cut sheets of paper having a first perforation and a first thickness;

a cover having a second perforation and a second thickness;

a clip having a first member, a second member, and an U-shape member connected to both said first and second members, said first and second members inserted into said receptacle;

a first groove formed on said first member and engaged with said first wall, having a first length approximately equal to the thickness of said first wall;

a second groove formed on said second member and engaged with said second wall, having a second length approximately equal to a summation of said second thickness of said cover and the thickness of said second wall; and said first length being different from said second length.

2. The binder of claim 1, further comprised of:

at least two of said receptacle; and at least two of said clip inserted into said receptacle.

3. The binder of claim 1, further comprised of a clamping device formed on said supporting stand, holding said cover securely against said supporting stand.

4. The binder of claim 1, further comprised of said cover being held securely against said supporting stand by both a distal end formed on said second member and a protrusion portion between said U-shape member and said second member.

5. The binder of claim 1, further comprised of a difference between the lengths of said first and second grooves corresponding to said second thickness of said cover.

6. A binder, comprising:

a supporting stand including a receptacle having a first wall and a second wall;

cut sheets of paper having a first perforation and a first thickness;

a cover having a second perforation and a second thickness;

a clip having a first member, a second member, and an U-shape member connected to both said first and second members, said first and second members inserted into said receptacle;

a first groove formed on said first member and engaged with said first wall, having a first length approximately equal to the thickness of said first wall;

a second groove formed on said second member and engaged with said second wall, having a second length approximately equal to a summation of said second thickness of said cover and the thickness of said second wall; and a difference between the lengths of said first and second grooves corresponding to said second thickness of said cover.

7. The binder of claim 6, further comprised of said first length being different from said second length.

8. The binder of claim 6, further comprised of:

at least two of said receptacle; and at least two clips inserted into said receptacles respectively.

9. The binder of claim 6, further comprised of a clamp device formed on said supporting stand, holding said cover securely against said supporting stand.

10. A binder, comprising:

a base;

a supporting stand disposed on said base, supporting cut sheets of paper and a cover;

a receptacle having a first side and a second side;

a first perforation formed on said cut sheets of paper;

a second perforation formed on said cover;

a clip having a first member, a second member, and an U-shape member connected to both said first and second members, said first and second members inserted into said receptacle, only said second member inserted into said second perforation;

a first groove formed on said first member, having a first length approximately equal to the thickness of said first wall;

a second groove formed on said second member, having a second length approximately equal to a summation of the thickness of said second wall and said cover; and said first length of said first groove of said clip being different from said second length of said groove.

11. The binder of claim 10, further comprised of a difference between lengths of said first and second grooves corresponding to the thickness of said cover.

12. The multi-functional learning system of claim 10, further comprised of said cover being held securely against said supporting standby both a distal end formed on said second member and a protrusion portion between said U-shape member and said second member.

13. The binder of claim 10, further comprised of a clamping device formed on said supporting stand, holding said cover securely against said supporting stand.

14. The binder of claim 10, further comprised of:

at least two of said receptacle; and at least two of said clip inserted into said receptacle.

15. A binder device, comprising:

a supporting stand having a receptacle;

a clip engaging said receptacle and having a first member, a second member, and an inverted U-shape;

a first groove formed on said first member, being contactable with a first side of said receptacle and having a first length; and a second groove formed on said second member, being contactable with a second side of said receptacle and having a second length different from said first length of said first groove.

16. The binder device of claim 15, further comprised of:

a sheet of paper having a perforation;

a cover;

said U-shape member being inserted into said perforation of said sheet of paper; and said second member holding said cover securely against said supporting stand.

17. The binder device of claim 15, further comprised of:

a cover having a thickness, attached to said supporting stand; and a difference between the lengths of said first and second grooves corresponding to said thickness of said cover.

18. The binder device of claim 14, further comprise of:

a cover attached to said supporting stand; and a clamping device formed on said supporting stand, holding said cover securely against said supporting stand.

* * * * *